United States Patent [19]
Vogel et al.
[11] 4,217,483
[45] Aug. 12, 1980

[54] TERMINAL BLOCK FOR SINGLE PHASE OR THREE PHASE WIRING OF AN IMMERSION HEATER ASSEMBLY AND METHODS OF WIRING

[75] Inventors: Alan D. Vogel, Laurel, Md.; Fred E. Snyder, Princeton, N.J.

[73] Assignee: Electro-Therm, Inc., Laurel, Md.

[21] Appl. No.: 926,793

[22] Filed: Jul. 21, 1978

Related U.S. Application Data

[63] Continuation-in-part of Ser. No. 735,864, Oct. 27, 1976, abandoned.

[51] Int. Cl.² ..... H05B 3/82

[52] U.S. Cl. ..... 219/541; 174/138 R; 219/320; 219/488; 338/295; 338/326; 339/32 R

[58] Field of Search ..... 174/59, 138 R, 138 G, 174/138 J; 219/316, 318, 320, 321, 331, 335, 336, 488, 523, 537, 541; 310/71; 318/225 R, 225 A, 245, 296; 338/240, 241, 295, 320, 325, 326; 339/18 R, 18 P

[56] References Cited

U.S. PATENT DOCUMENTS

| | | | |
|---|---|---|---|
| 1,915,199 | 6/1933 | Park | 174/59 X |
| 2,155,239 | 4/1939 | Randolph | 338/295 X |
| 2,321,999 | 6/1943 | Dalton | 310/71 X |
| 2,531,719 | 11/1950 | Alvino | 310/71 X |
| 2,594,069 | 4/1952 | Poehlmann | 310/71 X |
| 2,874,317 | 2/1959 | Couse | 310/71 |

FOREIGN PATENT DOCUMENTS

| | | | |
|---|---|---|---|
| 521221 | 3/1921 | France | 310/71 |
| 639878 | 5/1962 | Italy | 339/31 M |
| 302769 | 12/1928 | United Kingdom | 310/71 |
| 373153 | 5/1932 | United Kingdom | 318/225 R |

*Primary Examiner*—Laramie E. Askin
*Attorney, Agent, or Firm*—Warren N. Low

[57] ABSTRACT

A terminal block for simplified wiring of an electrical immersion heater assembly by providing for either single phase or three phase wire-up in opposite faces of the block. The terminal block has an electrically insulating body of disc-like configuration with three recesses defined in a first face of the block, each recess adapted to receive a lead connecting strap having a pair of apertures. Each of the three recesses has two bores extending into the body, the apertures of the straps alignable with the bores, for receiving leads of three separate heating elements through the apertures and into the bores for three phase wiring in the first face. The opposite face has an X-shaped recess which encompasses only four of the six bores for single phase wiring of four leads of the heating elements with a pair of curved straps. The body is of conical frustrum shape for better sealing characteristics and includes two additional bores adapted for receiving thermowells.

14 Claims, 12 Drawing Figures

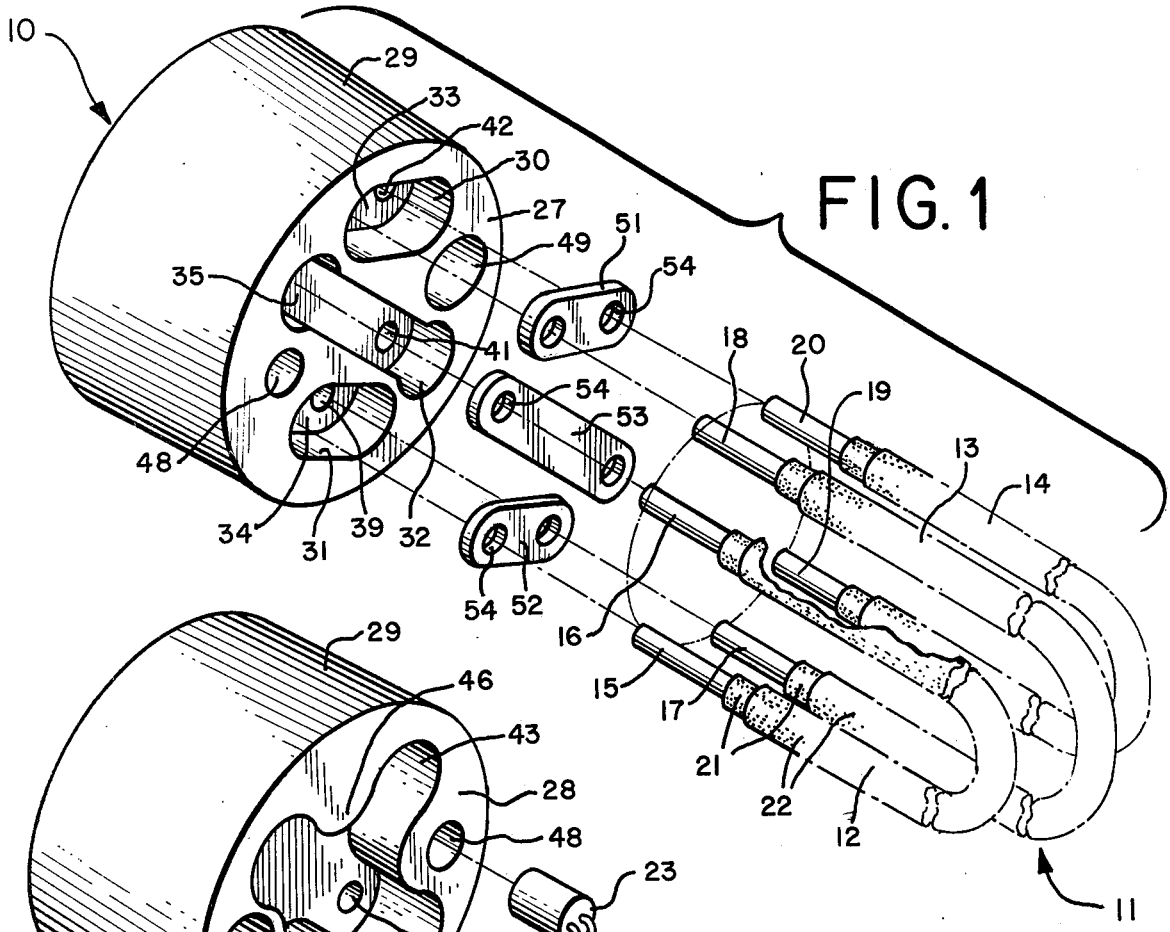
FIG. 1
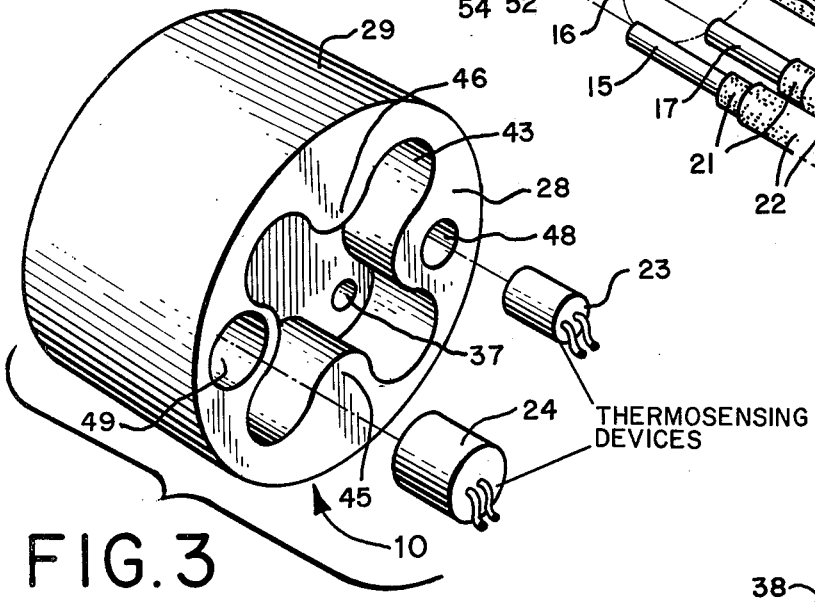
FIG. 3
FIG. 2
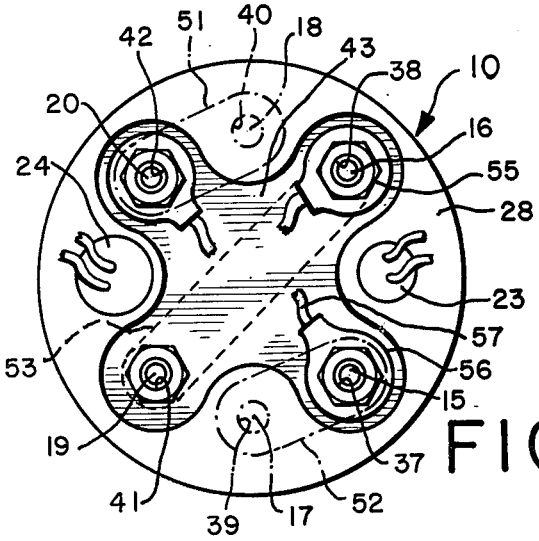
FIG. 4
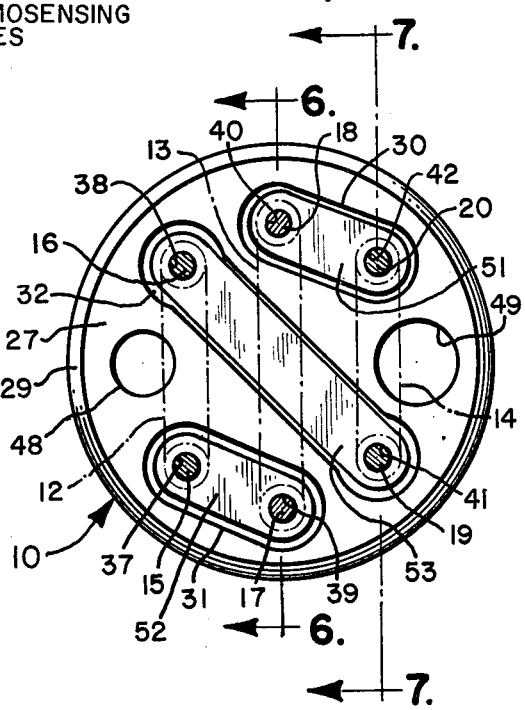

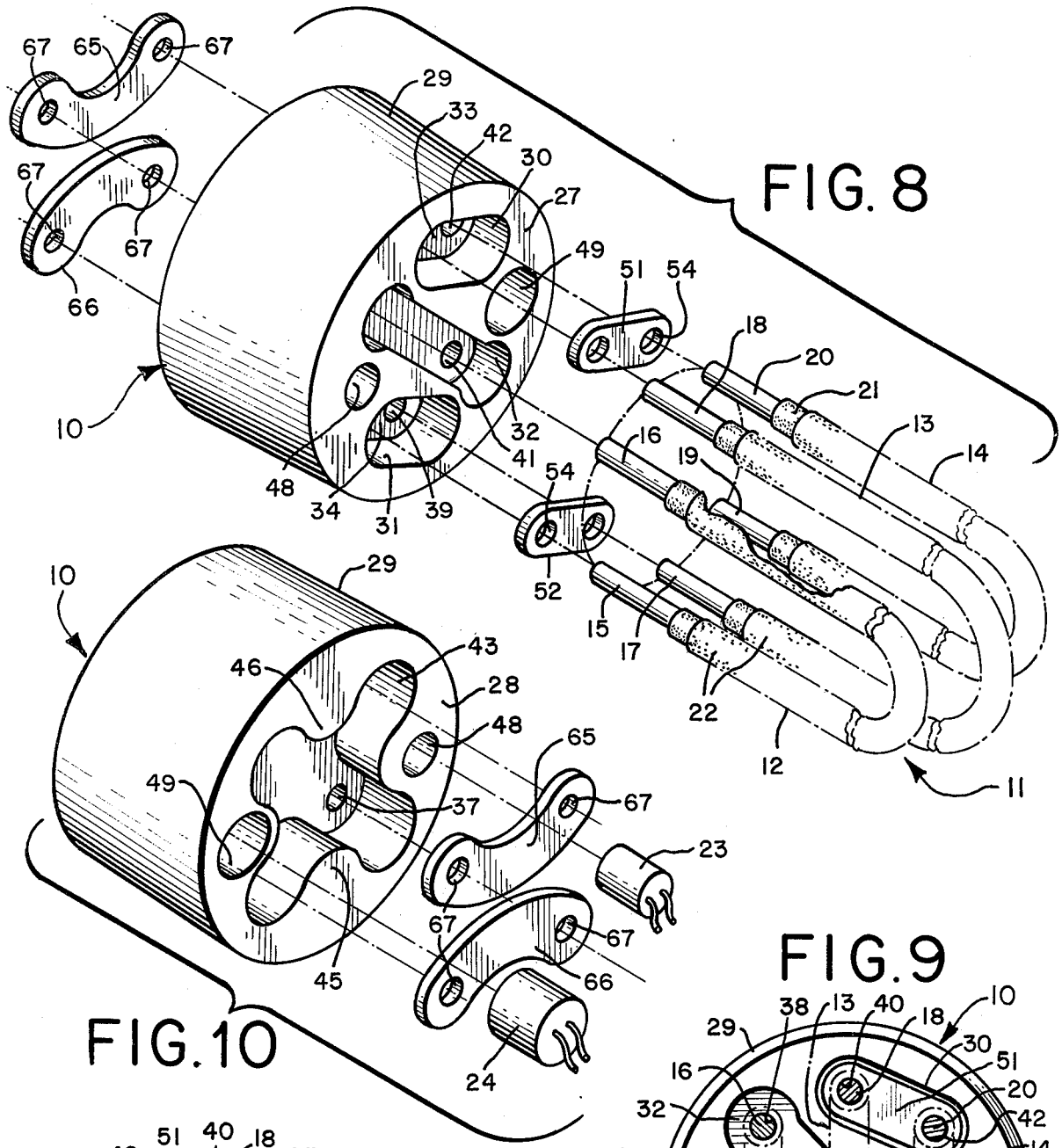
FIG. 8
FIG. 10
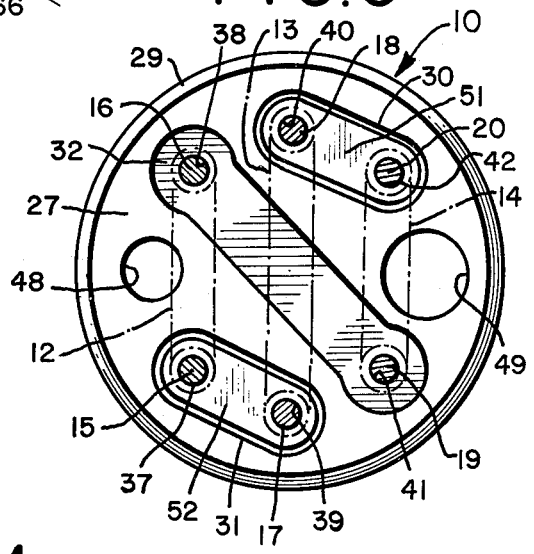
FIG. 9
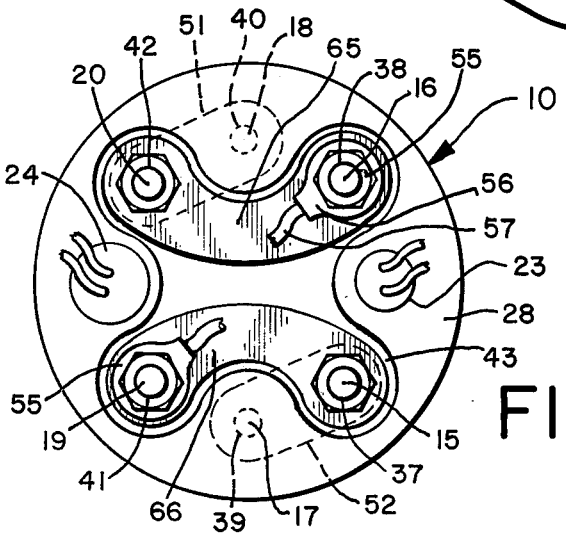
FIG. 11

TERMINAL BLOCK FOR SINGLE PHASE OR THREE PHASE WIRING OF AN IMMERSION HEATER ASSEMBLY AND METHODS OF WIRING

This is a continuation-in-part of prior patent application Ser. No. 735,864, filed on Oct. 27, 1976, now abandoned.

BACKGROUND OF THE INVENTION

This invention relates to a terminal block for use in wiring an immersion heater assembly and is more particularly concerned with improvements in an electrically insulating terminal block for supporting electrical heating elements and providing for simplified three phase wiring of the heating elements in a first face of the block or single phase wiring thereof in an opposite face.

Electric rod-type heating elements are commonly used in a variety of appliances, such as dishwashers, water heaters and stoves, to heat water or other fluid to a desired temperature. These heating elements generally consist of a resistance wire surrounded by a concentric sleeve of heat conductive and electrically insulating material, such as magnesium oxide, and an outer electrically and heat conductive metal sheath. Usually such heating elements are of a curved or U-shape such that leads of the heating element are relatively adjacent to facilitate electrical connection thereto. To this end, a terminal block is often provided for electrical connection of the leads of the heating elements and for additionally supporting the heating elements. The terminal block also provides a liquid-tight seal between the heating elements and the appliance.

Replacement of some of the heating elements or the terminal block may be necessary due to mechanical or electrical failures or because of other conditions, such as the accumulation of encrusting deposits upon the heating elements which reduce the heating efficiency thereof. In replacing some of the heater elements or the terminal block, it may not be known in advance whether the heating elements are wired to accommodate a single phase power source or a three phase power source. The serviceman must therefore be equipped to make appropriate electrical connections for either type of power source. It is generally easier and less expensive to appropriately wire the heating elements than it is to change to a different phase power source.

Terminal blocks for supporting immersion type electrical heater assemblies have been developed heretofore for use in the field where it may be desirable to connect the heating elements in parallel for a single phase load, as by forming electrical connections between leads of the heating elements with straps or jumpers. Alternatively, it may be desirable to connect the heating elements in a delta configuration, with a different arrangement of the straps between heating element leads, for a three-phase load. Many prior art terminal blocks require attention during the installation procedure to provide adequate electrical clearances or spacing between the lead connection straps or jumpers, or employ insulating washers and fishpaper which necessitates the use of additional materials and increases the time required to mount and install the heating elements. Many of the prior art terminal blocks also present all six leads from the heating elements for either single phase or three phase wiring on a single surface or face of the terminal block. This further complicates the wiring procedures and increases the likelihood that at least some of the heating elements will be miswired. For instance, if one of the heating elements has both leads electrically connected, the heating element is thereby shorted such that no electrical power is applied thereto and, accordingly, the heating element will not provide any heat. Miswiring of the heating elements may not be noticed until the appliance is reassembled and tested thereby resulting in a considerable loss of labor in correcting the wiring. If adequate testing or inspection is not performed, any miswiring may go unnoticed which can, depending upon the application, result in substandard performance of the appliance.

SUMMARY OF THE INVENTION

The present invention is directed to a terminal block for supporting an immersion heater assembly, including three electrical heating elements, in which wiring of leads of the heating elements for either single phase or three phase power sources is more convenient and simplified. An electrically insulating body defines a disc of substantial axial dimension with a pair of faces on opposite sides of the disc. First, second and third recesses are defined in the first face and are adapted for receiving therein electrically conductive straps with two apertures in each strap to electrically connect between leads of different heating elements. Six bores, two in each recess, extend into the body, the bores each adapted for receiving one electrical lead of a heating element to support the heating element and to permit electrical connection to the leads thereof. The third recess is disposed along a diameter of the body. Three phase wiring of the heating elements is completed by placing an electrically conductive strap in the third recess prior to inserting the heating elements into the terminal block.

A fourth recess of X-shape is defined in an opposite face of the terminal block and encompasses only four of the six bores. The fourth recess is adapted for single phase wiring of the heating elements by receiving a pair of curved electrically conductive straps with two apertures in each strap, for respectively connecting leads of different heating elements.

The invention is further directed to terminating two of the bores which extend into the body of the terminal block from recesses in the first face such that the two bores do not extend through the body to the opposite face of the terminal block or to the fourth recess therein, but instead terminate in a pair of lobes which are an integral portion of the terminal block body. The lobes provide further separation and electrical isolation of the four bores which extend between the recesses in the first face and the fourth recess in the opposite face of the body. Even though only four of the six leads of the heating elements are provided at the opposite face, appropriate leads are presented thereat for connection to a three phase power source or for alternatively wiring the leads for a single phase power source at the opposite face. Since the number of bores extending through the body is reduced from six to four, the risk of fluid leakage through the terminal block due to inadequate sealing is correspondingly reduced.

According to other aspects of the invention, the terminal block is in the form of a conical frustrum for better sealing characteristics with an aperture in a wall of an appliance, the bores are arranged in a circular pattern for receiving the heating elements in a generally parallel and spaced apart relationship, and additional bores are provided in the body for receiving thermosensing devices.

BRIEF DESCRIPTION OF THE DRAWINGS

The features of the present invention, which are believed to be novel, are set forth with particularity in the appended claims. The invention, together with the further advantages thereof, can best be understood by reference to the following description taken in conjunction with the accompanying drawings, in the several figures in which like reference numerals identify like elements, and in which:

FIG. 1 is an exploded perspective view of the terminal block of the present invention illustrating a typical insertion of leads of three heating elements into bores in the terminal block and insertion of electrically conductive straps in each of three recesses of a first face of the terminal block to electrically connect leads of the heating elements in a three phase configuration;

FIG. 2 is a plan view of the first face of the terminal block with the electrically conductive straps inserted into recesses of the first face for three phase connection of the three heating elements, which are shown in dashed lines, in a generally parallel and spaced apart relationship;

FIG. 3 is an exploded perspective view illustrating an opposite face of the terminal block to that of FIG. 1, also in the three phase wiring arrangement, and further illustrating a pair of thermosensing devices which are insertible into bores of the terminal block;

FIG. 4 is a plan view of the opposite face of the terminal block illustrating connection to three of the four leads of the heating elements for connection to a three phase power source and further illustrating in dashed lines the electrically conductive straps in the first face;

FIG. 8 is an exploded perspective view of the terminal block illustrating a typical insertion of the leads of the three heating elements to bores of the terminal block with appropriate electrically conductive straps for connection of the heating elements in a single phase configuration;

FIG. 9 is a plan view of the first face of the terminal block illustrating two electrically conductive straps inserted into nondiametric recesses of the first face in conjunction with the three generally parallel and spaced apart heating elements for facilitating a single phase wiring arrangement;

FIG. 10 is an exploded perspective view of an opposite face of the terminal block to that of FIG. 8 illustrating additional curved and electrically conductive straps insertible into the generally X-shaped recess in the opposite face for completion of wiring of the heating elements in a single phase circuit and further illustrating a pair of thermosensing devices insertible into other bores;

FIG. 11 is a plan view of an opposite face of the terminal block to that of FIG. 9 illustrating the wiring and strapping arrangement of four leads of the heating elements to complete the single phase wiring thereof and to connect the heating elements to a single phase power source;

DESCRIPTION OF A PREFERRED EMBODIMENT

Figure 6:
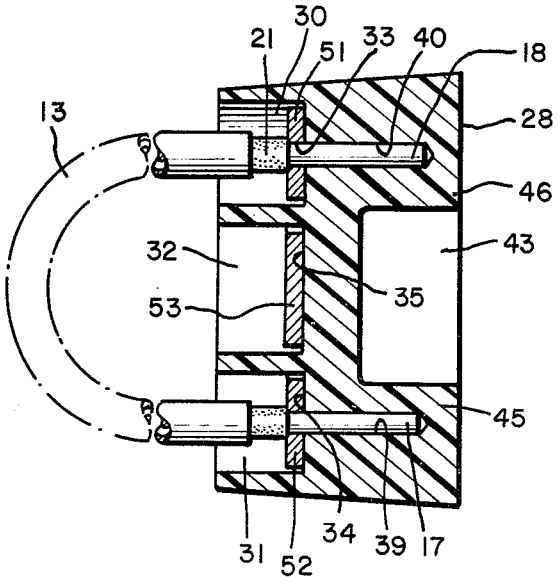
FIG. 6 is a sectional view of the terminal block taken along the lines 6—6 in FIG. 2 illustrating insertion of the leads of a heating element into the block and termination of the bores in the terminal block short of the opposite face.
Figure 7:
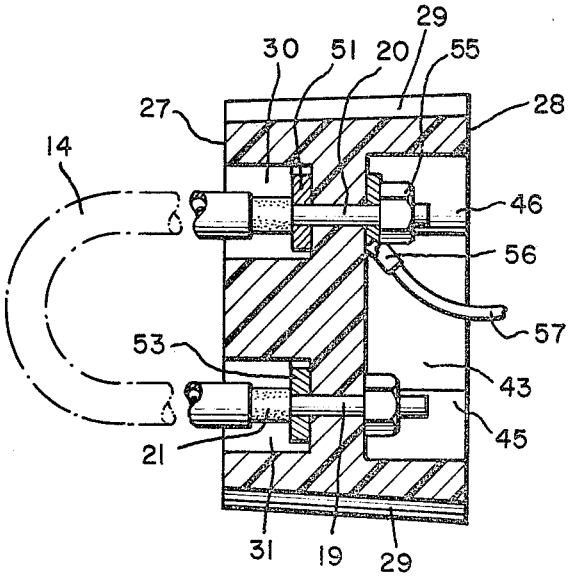
FIG. 7 is a sectional view of the terminal block taken along line 7—7 of FIG. 2 illustrating other bores extending through the block to a recess in the opposite face for connection of the leads of the heating elements, as to a three phase power source.
Figure 5:
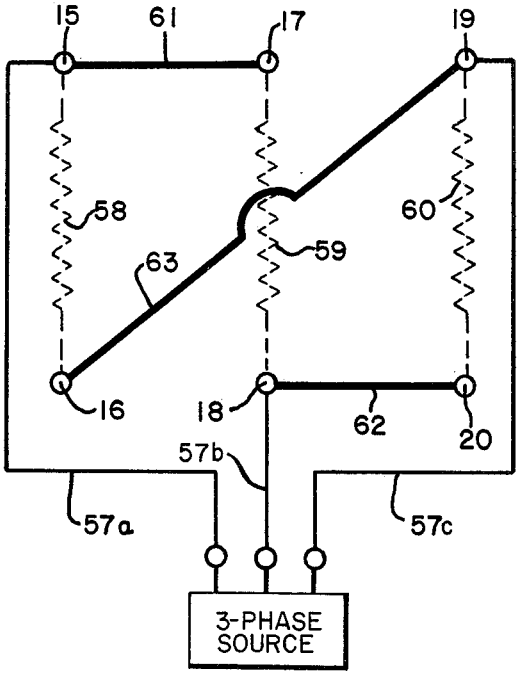
FIG. 5 is a schematic diagram of the wiring of the heating elements, shown in dashed lines as resistors, in three phase circuit with the electrically conductive straps shown in heavy lines between leads or terminals of the heating elements.

Referring first to FIGS. 1 through 4, there is illustrated a terminal block, generally designated 10, for mounting and supporting an immersion-type electrical heater assembly, generally designated 11, and for electrical connection thereof in a three phase configuration. The heater assembly 11 includes a set of three separate heating elements 12, 13, 14 which are of typically looped or U-shape such that terminal ends thereof may be arranged in a circular configuration. Leads for electrically connecting the heater elements 12, 13, 14 into the desired single phase or three phase configuration for supplying electrical power thereto are respectively leads 15, 16 for heating element 12, leads 17, 18 for heating element 13 and leads 19, 20 for heating element 14. A metallic sheath 22 is provided over most of the exterior surfaces of the heating elements 12, 13, 14, but the sheaths 22 terminate short of the leads 15, 16, 17, 18, 19, 20 to expose a layer of insulating material 21 for a short axial distance between the sheaths 22 and each lead. One of the heating elements 13 has a greater distance between the leads 17, 18 thereof than between the leads 15, 16 or 19, 20 of respective heating elements 12, 14 such that the leads will define a circular orientation when the heating element 13 is centrally located with respect to heating elements 12, 14 will all of the elements 12, 13, 14 in a generally parallel and spaced apart relationship. Also insertible into the terminal block 10 are a pair of thermosensing devices, one of the devices 23 provided for temperature control and the other device 24 provided for high temperature limit control. The thermosensing devices 23, 24 are insertible into the terminal block 10 at opposite diametric positions, also on the circle defined by the leads 15, 16, 17, 18, 19, 20 of the heating elements 12, 13, 14.

The terminal block 10, as it is illustrated in FIGS. 1 through 10, is in the form of a conical segment or frustrum such that the terminal body 10 has improved sealing characteristics due to the wedging action of the conical frustrum when inserted into an appropriately sized aperture of an appliance (not shown). Accordingly, a first circular face 27 is of smaller diameter than an opposite circular face 28; and conical sides 29 of the terminal block 10 are continuously tapered between the first and opposite faces 27, 28.

According to one aspect of the invention, a first recess 30 and a second recess 31 are defined into the first face 27. The first and second recesses 30, 31 are separated and disposed at generally opposite diametric positions, but the first and second recesses 30, 31 are not longitudinally disposed along the diameter extending therebetween. A third recess 32 is also defined in the first face 27, but is longitudinally disposed along a diameter which does not intersect the first and second recesses 30, 31. Each of the recesses 30, 31, 32 is preferably of the same depth into the terminal block 10 and have flat bottom surfaces 33, 34, 35, respectively, which define a common planar surface (FIG. 6). Six bores 37, 38, 39, 40, 41, 42 extend from the bottom surfaces 33, 34, 35 of the respective first, second and third recesses 30, 31, 32 into the body of the terminal block 10; with two bores in each of the recesses 30, 31, 32 near ends thereof. Thus, with particular reference to FIGS. 2 and 9, bores 40, 42 extend from the first recess 30 into the terminal block 10, bores 37, 39 extend from the second recess 31 into the block 10 and bores 38, 41 extend from the third recess 32 into the block 10. Each of the bores 37, 38, 39, 40, 41, 42 is of a size which permits a respective lead 15, 16, 17, 18, 19, 20 of the elements 12, 13, 14 to be inserted therein. The bores 37, 38, 39, 40, 41, 42 are also arranged in a circular configuration of similar diameter to that defined by the heating elements 12, 13, 14.

In accordance with another aspect of the invention, the opposite face 28 of the terminal block 10 is provided with a recess 43 defined therein of substantially X-shape (FIGS. 3, 4, 10, 11) for encompassing only four of the bores 37, 38, 41, 42. The other two bores 39, 40 terminate in opposite lobes 45, 46, respectively, defined by the X-shaped recess 43, as is best illustrated in FIG. 6. Thus, the bores 30, 40 do not either open onto the opposite face 28 or into the X-shaped recess 43 defined therein. The importance of this structural arrangement will be more fully appreciated hereinafter. The bores 39, 40 are of a size related to the diameter of the leads 17, 18 of the heating element 13 to frictionally engage the leads 17, 18 to support the heating element 13. If desired, apertures 54 in electrically conductive straps 51, 52 may also frictionally engage the leads 17, 18 or the straps 51, 52 may be soldered or welded to the leads 17, 18 to provide further support for heating element 13.

Another pair of bores 48, 49 extend entirely through the terminal block 10 between the first face 27 and the opposite face 28 for insertion therein of the respective thermosensing devices 23, 24.

With reference to FIG. 1, each of the first, secnd and third recesses 30, 31, 32 is adapted to receive therein an appropriately sized and electrically conductive strap 51, 52, 53, respectively. Each of the straps 51, 52, 53 have a pair of apertures 54 extending therethrough which are related in diameter to the bores 37, 38, 39, 40, 41, 42 and which are alignable therewith. According to another aspect of the invention, the heating elements 12, 13, 14 may be wired in a three phase configuration by providing the electrically conductive straps 51, 52, 53 in the first, second and third recesses 30, 31, 32 of the first face 27 of the terminal block 10 prior to inserting leads of the heating elements 12, 13, 14 therein. The straps 51, 52, 53 are placed in the respective recesses 30, 31, 32 and aligned with the bores 37, 38, 39, 40, 41, 42 such that respective leads 15, 16, 17, 18, 19, 20 of the heating elements 12, 13, 14 will be inserted into a respective bore. When the heating elements 12, 13, 14 are fully inserted into the terminal block 10, the insulating material 21 of the heating elements 12, 13, 14 will contact against the electrically conductive straps 51, 52, 53. The four leads 15, 16, 19, 20 of the heating elements 12, 14 will then extend into the X-shaped recess 43 (FIG. 3), as for securement by self-tapping and threading nuts 55. If desired, an electrical terminal 56 may be placed on appropriate leads 15, 16, 19, 20 in the recess 43 for connection, in conjunction with wires 57, to a source of electrical power (not shown) before threading nuts 55 on said leads 15, 16, 19, 20.

As noted above, wiring of the heat r assembly 11 is achieved by use of the electrically conductive straps 51, 52, 53 in recesses 30, 31, 32 of the first face 27 of the terminal block 10. The three phase wiring arrangement, in delta configuration, can be more fully understood from the schematic diagram of FIG. 5 wherein resistor 58 represents the resistance of heating element 12, resistor 59 represents the resistance of heating 13 and resistor 60 represents the resistance of heating element 14. The resistors 58, 59, 60 have respective leads 15, 16, 17, 18, 19, 20 corresponding to the same leads of the heating elements 12, 13, 14. The leads 61, 62, 63, which are in heavier lines, represent the respective straps 51, 52, 53. The leads 15, 18, 19 may be connected to respective wires 57*a*, 57*b*, 57*c* to define a three wire, three phase connection for the resistors 58, 59, 60, and hence for the heater assembly 11.

According to another aspect of the invention, the three element heater assembly 11 may be wired for a single phase power source on an opposite face 28 of the terminal block 10. With reference to FIGS. 8 through 11, it can readily be seen that positioning of the heating elements 12, 13, 14 and insertion thereof into the first face 27 of the terminal block 10 is similar to the three phase wiring configuration presented above, but that the conductive strap 53 associated with the third recess 32 is not used in the single phase wiring. However, the conductive straps 51, 52 continue to be used in the associated rec ses 30, 31. For completing the single phase wiring configuration, a pair of curved straps 65, 66 are provided with a shape which permits insertion thereof into the X-shaped recess 43 in the opposite face 28 of the terminal block 10. Each of the curved straps 65, 66 is provided with a pair of apertures 67 extending therethrough near ends of the straps 65, 66 such that the apertures 67 are alignable with the leads 15, 16, 19, 20 which extend through the respective bores 37, 38, 41, 42 and which are encompassed by the X-shaped recess 43. Preferably, the horizontal distances between the leads 15, 19 and 16, 20 (FIG. 10) will differ from the respective vertical distances between leads 15, 16, and 19, 20 such that the curved straps 65, 66 may only be oriented in substantially horizontal directions to connect the desired leads 15, 19 and 16, 20 as shown in FIG. 10. It is not desirable to dispose the straps 65, 66 in substantially vertical directions to respectively connect leads 15, 16 and 19, 20 since this would electrically short the respective heating elements 12, 13 (FIG. 9). Lead 18 of the centrally located heating element 13 is supplied with electrical power from the curved strap 65 (FIG. 11) by the strap 51 between the leads 18, 20, with the strap 51 remaining located in the recess 30 in the first face 27. Similarly, strap 66 supplies electrical power to the lead 17 of heating element 13 by the strap 52 between the leads 15, 17 with the strap 52 remaining in recess 31 in the first face 27. After the straps 65, 66 have been placed over respective leads 16, 20, and 15, 19 in the recess 43, electrical terminals 56 may be placed over appropriate leads, such as 16, 19, before nuts 55 are threaded to the leads 16, 19 such that single phase electrical power may be supplied to the strap 65, 66 by wires 57 attached to the terminals 56.

Figure 12:
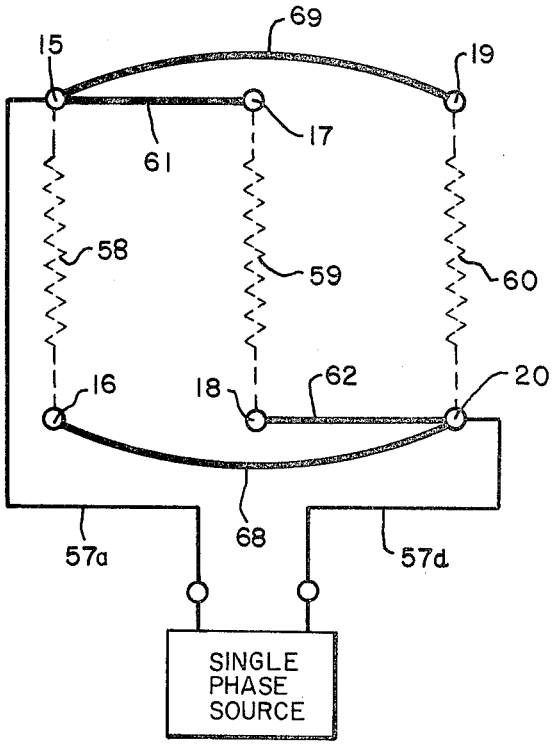
FIG. 12 is a schematic circuit diagram of the single phase electrical connection of the heating elements, which are indicated in dashed lines as resistors, with the electrically conductive straps illustrated in the heavy lines between leads of the heating elements.

The single phase connection of the heater assembly 11 may be more fully appreciated from the schematic diagram of FIG. 12 wherein the resistors 58, 59, 60 are representative of the resistances of the respective heating elements 12, 13, 14 with the resistors 58, 59, 60 having respective leads 15, 16, 17, 18, 19, 20, corresponding to those of the heating elements 12, 13, 14. The heavy lines 61, 62 are representative of the electrically conductive straps 51, 52 and the curved heavy lines 68, 69 are representative of the curved electrically conductive straps 65, 66. Leads 15, 20 may be brought out by wires 57*a*, 57*d* to define a two wire single phase connection to a single phase power source (not shown).

The terminal block 10 may be readily fabricated of a suitable plastic material, such as Bakelite or similar resin, by known plastic molding techniques.

Implicit in the above description of the terminal block 10 were methods of wiring a three element heater assembly 11 for either single phase or three phase power. The basic method for three phase wiring includes providing a terminal block 10 of the above-described type, inserting a conductive strap into each of the three recesses 30, 31, 32 in the first face 27 such that apertures 54 of the straps 51, 42, 53 are in alignment with bores 37, 38, 39, 40, 41, 42, and inserting leads 15, 16, 17, 18, 19, 20 of the heating elements 12, 13, 14 through the apertures 54 in the straps 51, 52, 53 into respective bores 37, 38, 39, 40, 41, 42 such that the heating elements 12, 13, 14 are in a substantially parallel and spaced apart relationship. Leads 15, 16, 19, 20 of those heating elements 12, 14 which extend into the X-shaped recess 43 in the opposite face 28 may then be threadedly secured.

The basic single phase method includes providing a terminal block 10 of the above described type, inserting a conductive strap into each of two recesses 30, 31 in the first face 27 such that apertures 54 of the straps 51, 52 are in alignment with bores 37, 39, 40, 42, inserting leads 15, 17, 18, 20 of the heating elements 12, 13, 14 through the apertures 54 in the straps 51, 52, inserting all of the leads 15, 16, 17, 18, 19, 20 into respective bores 37, 38, 39, 40, 41, 42 of the terminal block 10 such that the heating elements 12, 13, 14 are in a substantially parallel and spaced apart relationship, placing a pair of curved straps 65, 66 each with a pair of apertures 67 onto respective leads 15, 19 and 16, 20 in the fourth recess 43 into the opposite face 28, and securing said straps 65, 66 to said leads 15, 16, 19, 20.

It will be understood that various changes and modifications may be made without departing from the spirit of the invention as defined in the following claims, and equivalents thereof.

We claim:

1. A terminal block for either single phase or three phase wiring of an electrical immersion heater assembly consisting of three separate heating elements each with a pair of electrical leads, said terminal block comprising:

an electrically insulating body defining a disc of substantial axial dimensions with a pair of faces on opposite sides of said disc;

first, second and third recess means defined into a first face of said body, each of said recess means separated from the other of said recess means for electrical isolation;

six bores, two bores in each of said recess means, extending into said body, each of said six bores adapted for receiving one electrical lead of a heating element for supporting said heating element and permitting electrical connection to the leads thereof;

said first and second recess means adapted for receiving therein first and second electrically conductive means each with a pair of apertures alignable with the two bores in each of the first and second recess means to receive leads of the heating elements through the apertures and into the bores;

said third recess means in the first face adapted for three phase wiring of said heating elements by receiving a third electrically conductive means with a pair of apertures alignable with the two bores in the third recess means to receive leads of the heating elements through the apertures and into the bores; and fourth recess means defined into an opposite face of said body, said fourth recess means encompassing only a predetermined four of the six bores, including at least one bore from each of said first, second, and third recess means, and adapted for single phase wiring of said heating elements by receiving fourth and fifth electrically conductive means each with a pair of apertures, the apertures of said fourth and fifth conductive means each being alignable with bores in said fourth recess means for electrical connection to leads of the heating elements inserted through said four bores.

2. The terminal block as defined in claim 1 wherein said six bores are spaced in a circular arrangement.

3. The terminal block as defined in claim 2 wherein said bores are arranged in circle and spaced at approximately equal distances from an axis of said body, with opposite bores arranged in substantially parallel pairs for generally parallel insertion of said heating elements.

4. The terminal block as defined in claim 1 wherein said electrically insulating body is a conical frustrum.

5. The terminal block as defined in claim 1 wherein said third recess means comprises a third recess which is longitudinally disposed along a diameter which does not intersect said first or second recess means, ends of said third recess encompassing diametrically opposite bores in said body.

6. The terminal block as defined in claim 5 wherein said first and second recess means comprise first and second recesses transversely disposed along another diameter of the first face at diametrically opposite positions therealong, said first and second recesses each encompassing adjacent pairs of bores.

7. The terminal block as defined in claim 1 wherein said first, second and third recess means have flat bottom surfaces which define a common plane.

8. The terminal block as defined in claim 1 wherein said fourth recess means defines a substantially X-shaped recess in said opposite face with said X-shaped recess encompassing said four of the six bores into the three recess means in the first face.

9. The terminal block as defined in claim 8 wherein two of the six bores into said three recess means in the first face terminate in a pair of diametrically opposed lobes which are defined by said X-shaped recess in said opposite face.

10. The terminal block as defined in claim 1 further comprising at least one additional bore extending between said first and opposite faces, said additional bore adapted for insertion therein of a thermosensing means.

11. A terminal block for either single phase or three phase wiring of an electrical immersion heater assembly consisting of three separate heating elements, each with a pair of electrical leads, said terminal block comprising:

an electrically insulating body defining a conical frustrum of substantial axial dimension with a pair of faces on opposite sides of said frustrum;

first, second and third recesses defined in a first face of said body, said third recess longitudinally disposed along a diameter which does not intersect said first or second recesses, said first and second recesses transversely disposed along another diameter of said first face at diametrically opposite positions therealong, each of said recesses separated from the other of said recesses for electrical isolation;

six bores extending into said body, said bores being arranged in a circle, each of said first, second and third recesses encompassing two of the six bores, each of said six bores adapted for receiving one electrical lead of a heating element for supporting said heating element and permitting electrical connection to the leads thereof;

said first and second recesses adapted for receiving therein first and second electrically conductive straps, each strap having a pair of apertures alignable with the two bores in each of the first and second recesses to receive leads of the heating elements through the apertures and into the bores;

said third recess in the first face adapted for three phase wiring of said heating elements by receiving a third electrically conductive strap with a pair of apertures alignable with the two bores in the third recess to receive leads of the heating elements through the apertures and into the bores; and a fourth recess of substantially X-shape defined into an opposite face of said body, said fourth recess encompassing only a predetermined four of the six bores, including at least one bore from each of said first, second, and third recesses, with the remaining two bores terminating in a pair of diametrically opposed lobes defined by the X-shaped recess, said fourth recess adapted for single phase wiring of said heating elements by receiving fourth and fifth electrically conductive straps each with a pair of apertures, the apertures of said fourth and fifth straps alignable with the bores in said fourth recess for electrical connection to the leads of the heating elements inserted through said four bores.

12. A method of mounting and wiring a heating assembly in a terminal block with a plurality of electrically conductive straps for application of a three phase power source to said heater assembly;

said heater assembly including three separate heating elements, each heating element having a pair of leads in a parallel and spaced apart relationship;

said terminal block comprising an electrically insulating body defining a disc of substantial axial dimension with a pair of faces on opposite sides of said disc;

first, second and third recess means defined into a first face of said body, each of said recess means separated from the other of said recess means for electrical isolation;

six bores, two bores in each of said recess means, extending into said body, each of said six bores adapted for receiving one electrical lead of a said heating element for supporting said heating element and permitting electrical connection to the leads thereof;

said first and second recess means adapted for receiving therein first and second electrically conductive straps each with a pair of apertures alignable with the bores in each of the first and second recess means to receive leads of the heating elements through the apertures and into the bores;

said third recess means in the first face adapted for receiving therein a third electrically conductive strap with a pair of apertures alignable with the two bores in the third recess means to receive leads of the heating elements through the apertures and into the bores; and fourth recess means defined into an opposite face of said body and encompassing a predetermined four of the bores which extend into said body including at least one bore from each of said first, second, and third recess means, said method including the steps of:

inserting said conductive straps into said first, second and third recess means of said terminal block such that apertures in said straps are substantially in alignment with said bores; and inserting leads of each heating element through the apertures in said straps and into the bores of said terminal block such that said heating elements are in a substantially parallel and spaced apart relationship with no two leads of a single heating element inserted through the same strap.

13. The method as defined in claim 12 further comprising the additional steps of extending the heating element leads in four of said terminal block bores into said fourth recess means, and, threadedly securing the leads of said heating elements which extend into said fourth recess means in the opposite face of said terminal block.

14. A method of mounting and wiring a heater assembly in a terminal block with a plurality of electrically conductive straps for application of a single phase power source to said heater assembly;

said heater assembly including three separate heating elements, each heating element having a pair of leads in a parallel and spaced apart relationship;

said terminal block comprising an electrically insulating body defining a disc of substantial axial dimension with a pair of faces on opposite sides of said disc;

first, second and third recess means defined into a first face of said body, each of said recess means separated from the other of said recess means for electrical isolation;

six bores, two bores in each of said recess means, extending into said body, each of said six bores adapted for receiving one electrical lead of a heating element for supporting said heating element and permitting electrical connection to the leads thereof;

said first and second recess means adapted for receiving therein first and second electrically conductive straps each with a pair of apertures alignable with the two bores in each of the first and second recess means to receive leads of the heating elements through the apertures and into the bores; and fourth recess means defined into an opposite face of said body, said fourth recess means encompassing only a predetermined four of the six bores extending into the body, including at least one bore from each of said first, second, and third recess means, said fourth recess means adapted for single phase wiring of said heating elements by receiving third and fourth electrically conductive straps each with a pair of apertures, the apertures of said third and fourth conductive straps being alignable with bores in said fourth recess means for electrical connection to leads of the heating elements inserted through said four bores;

said method including the steps of:

inserting said first and second electrically conductive straps into said first and second recess means in the first face of said terminal.block such that the apertures in said first and second straps are substantially in alignment with said bores;

inserting leads of each heating element through the apertures in said first and second straps and into bores of said terminal block such that said heating elements are in a substantially parallel and spaced apart relationship with no two leads of a single heating element inserted through the same strap and with four of said leads extending into said fourth recess means;

placing said third and fourth electrically conductive straps onto the four leads of the heating elements which extend into said fourth recess means in said opposite face of the terminal block with said third and fourth straps respectively encompassing preselected different pairs of leads from those encompassed by said first and second straps; and securing said third and fourth electrically conductive straps to said four leads.

* * * * *